United States Patent [19]

Marschke

[11] 4,190,475

[45] Feb. 26, 1980

[54] PAPER ROLL WEB SPLICING

[75] Inventor: Carl R. Marschke, Phillips, Wis.

[73] Assignee: Marquip, Inc., Phillips, Wis.

[21] Appl. No.: 906,592

[22] Filed: May 16, 1978

[51] Int. Cl.[2] ..... B65H 19/08

[52] U.S. Cl. ..... 156/157; 156/267; 156/497; 156/502; 156/504; 156/543; 226/95; 226/97; 242/58.4; 242/58.5

[58] Field of Search ..... 156/157, 159, 266, 497, 156/504, 511, 517, 543, 267, 502; 242/58.4, 58.5; 226/91, 95, 97, 178

[56] References Cited

U.S. PATENT DOCUMENTS

| | | | |
|---|---|---|---|
| 3,184,364 | 5/1965 | Butler et al. | 156/504 |
| 3,498,515 | 3/1970 | Johnson | 226/97 |
| 3,586,006 | 6/1971 | Wendt | 242/58.4 |
| 3,886,031 | 5/1975 | Taitel | 156/504 |
| 3,891,158 | 6/1975 | Shearon et al. | 156/504 |
| 4,100,012 | 7/1978 | Meihofer et al. | 156/504 |
| 4,108,711 | 8/1978 | Hoffman | 156/497 |

*Primary Examiner*—Jerome W. Massie

*Attorney, Agent, or Firm*—Andrus, Sceales, Starke & Sawall

[57] ABSTRACT

An elongated transverse paper preparation head is provided which has multiple sides. One side is exposed to the operator and the other two back sides form, with suitable guide members, a guide path for threading alternate leading edges of fresh web to the splicing nip area. A spring bar holds the fresh web to an idler roll upstream of the nip. The fresh web end section is laid across the exposed head side to which a vacuum is applied, and a double faced adhesive tape is applied along the edge portion's exposed face. The edge is then cut off via a knife slot. The fresh web end section is peeled from the exposed vacuumized side of the head and is manually fed along the guide path. Positive air pressure is applied between the said head back side and the web to cause the web and the adhesive portion to be forced away from the head to eliminate interference therebetween. The splicer nip roll axes are disposed in a common plane which has a bridging portion at the nip. The nip roll for the fresh web is adapted to be driven and to have vacuum applied to its surface during said preparation. The construction is such that the fresh web path from the holding spring, across the idler roll and the exposed head face to the knife cut-off slot is equal to the fresh web path from the holding spring, around the idler roll and through the guides to the nip. During manual threading toward the nip, a loose loop is formed in the web. When the leading edge of the fresh web approaches the driven nip roll, it is pulled thereonto by the vacuum and up to the said plane. Braking stop bars are replaced by the said spring on one side and the adjacent idler roller on the other side. The idler roller has a high friction surface thereon and has a high inertia due to its mass. A high torque constant braking force is applied to the idler roller which causes the traveling expiring web to decelerate at a constant rate in a minimum controlled time interval.

22 Claims, 9 Drawing Figures

32a
58a
31a
13a
57a
8a
30a
12a
29a
10a
6a
21a
11a
23a
24a
22a
9a
33
49a
52a
18a
36a
56a
39
37a
20a
19a
58a
16a
17a
35
41
45
48
15a
28
34
53a
14
44
38
40
15
20
17
37
59
53
16
36
56
19
49
52
18
9
11
55
24
23
21
22
10
6
29
12
30
57
8
13
31
32
58

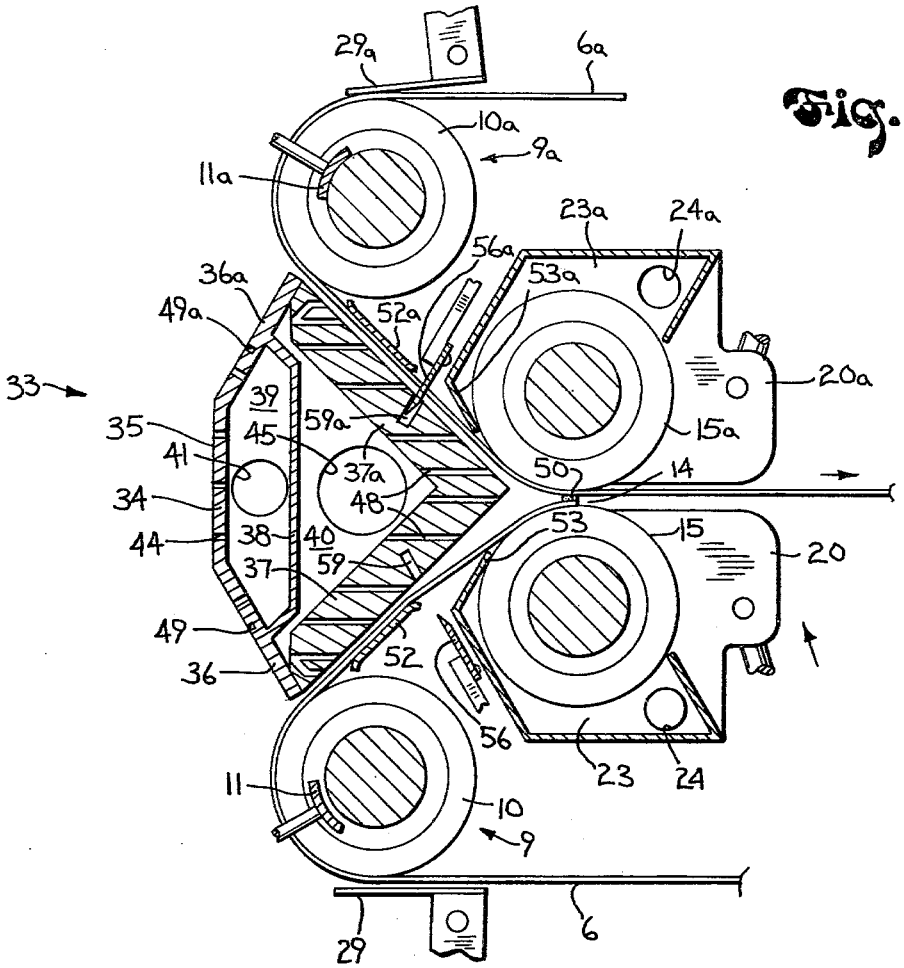
Fig. 7
Fig. 8
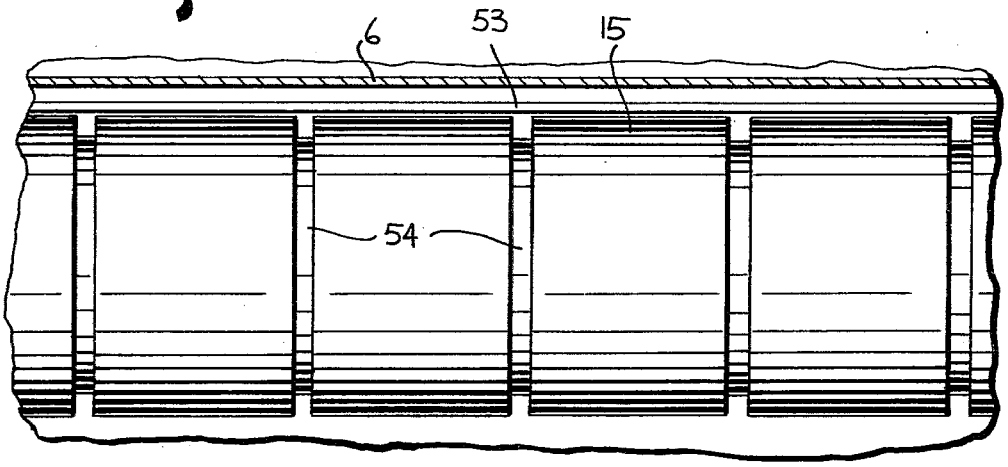

PAPER ROLL WEB SPLICING

BACKGROUND AND SUMMARY OF THE INVENTION

This invention relates to paper roll web splicing, and more particularly to a concept involving splicing together the new web from a fresh supply roll of paper and the web from a nearly exhausted supply roll of paper in a substantially continuous web feeding operation.

The concepts of the invention can be utilized in association with a large variety of devices wherein a web of paper or other like material is supplied. In such devices, the paper supply comprises a pair of paper rolls which alternately feed a web of traveling paper in substantially continuous fashion to the machine input. When one roll is exhausted, the other roll is substituted. To prevent extensive down time, it has been found desirable to quickly splice the web of a fresh paper roll onto the web of a nearly exhausted roll or a completely exhausted roll which has come free from its core.

In some splicing devices, it is desired to manually feed the leading end of a fresh web to the splicer area at the same time that the expiring web is still running through. The splicer nip area may be inaccessible to the operator, which makes manual feeding or threading very difficult.

For example, the leading edge portion of the fresh web normally has adhesive thereon for application by pressure to the expiring web at the splicing nip. For manual threading, it is necessary to apply the adhesive prior to threading. However, during threading the exposed adhesive may tend to contact and undesirably stick to parts of the splicer upstream of the splicing nip, thus hindering the progress of the web's leading edge toward the nip area.

In addition, it is desired that the leading edge of the fresh web be positioned exactly at the proper point in the splicing nip. With manual threading, it may be possible to attempt proper positioning by visual observation. However, "eyeballing" it is not always fully accurate and furthermore the nip may be positioned within the machine where it cannot be readily or safely observed.

Turning now to handling of the expiring web, it is already known to brake the web to a stop just before the trailing web end reaches the splicing device and so that the splice can be made on momentarily stopped webs. Heretofore, the braking devices have usually comprised a pair of transversely extending paper stop bars between which the expiring web is clamped. The frictional force applied by the clamped stationary bars to the web causes a dragging force thereon until the web comes to a complete stop.

For the most efficient and speedy braking, it is desired to apply a constant brake force during the web slowdown and wherein a minimum time has elapsed. Furthermore, it is desired to brake the web in such a way that the effect of varying web widths and longitudinal tensions in the system is negligable. The aforementioned stop bar system of braking does not lend itself to exact control over these factors.

Broadly, it is a task of the present invention to provide a web splicing apparatus which facilitates manual threading of the leading edge of a fresh web to the splicing nip. More specifically, one task is to eliminate interference between the adhesive coated leading edge portion of the fresh web and the parts of the splicer upstream from the nip. Another task is to automatically position the manually threaded fresh web leading edge exactly at the right spot in the splicing nip without the need for visual observation of the nip area.

It is a further task of the invention to provide a controlled constant rate of expiring web deceleration to brake the web to a stop in the shortest possible time and wherein the effect of various web widths and longitudinal tensions during braking is substantially eliminated.

In accordance with one aspect of the invention, an elongated transverse paper preparation head is provided which has multiple sides. One side is exposed to the operator and the other two back sides form, with suitable guide members, a guide path for threading alternate leading edges of fresh web to the splicing nip area. A spring holds the fresh web to an idler roll upstream of the nip. The fresh web end section is laid across the exposed head side to which a vacuum is applied, and a double faced adhesive tape is applied along the edge portion's exposed face. The edge is then cut off via a knife slot.

The fresh web end section is peeled from the exposed vacuumized side of the head and is manually fed along the guide path. Positive air pressure is applied between the said head back side and the web to cause the web and the adhesive portion to be forced away from the head to eliminate interference therebetween. The moving web floats along its path.

In accordance with another aspect of the invention, the splicer nip roll axes are disposed in a common plane which has a bridging portion extending between the spaced splicer nip roll peripheries during fresh web preparation. The nip roll for the fresh web is adapted to be driven and to have vacuum applied to its surface during said preparation. The construction is such that the fresh web path from the holding spring, across the idler roll and the exposed head face to the knife cut-off slot is exactly equal to the fresh web path from the holding spring, around the idler roll and through the guides to bridging portion of the said plane, which constitutes the actual nip. During manual threading toward the nip, a loose loop is formed in the web. When the leading edge of the fresh web approaches the driven nip roll, it is pulled thereonto by the vacuum and up to the said plane, at which time the web can be visually observed as having tightened around the idler roll.

In accordance with a further aspect of the invention, the previously used basically uncontrolled braking stop bars are replaced by the said spring on one side and the adjacent idler roller on the other side. The idler roller has a high friction surface thereon and has a high inertia due to its mass. A high torque constant braking force is applied to the idler roll which causes the traveling expiring web to decelerate at a constant rate in a controlled minimum time interval. The effects of other external factors are substantially eliminated.

BRIEF DESCRIPTION OF THE DRAWINGS

The accompanying drawings illustrate the best mode presently contemplated by the inventor for carrying out the invention.

In the drawings:

FIG. 7 is a view similar to FIG. 4 and showing the nip being closed and the cut off of the expiring web during splicing;

FIG. 8 is a view of the lower nip roll taken on line 8—8 of FIG. 6; and

DESCRIPTION OF THE PREFERRED EMBODIMENT

Figure 1:
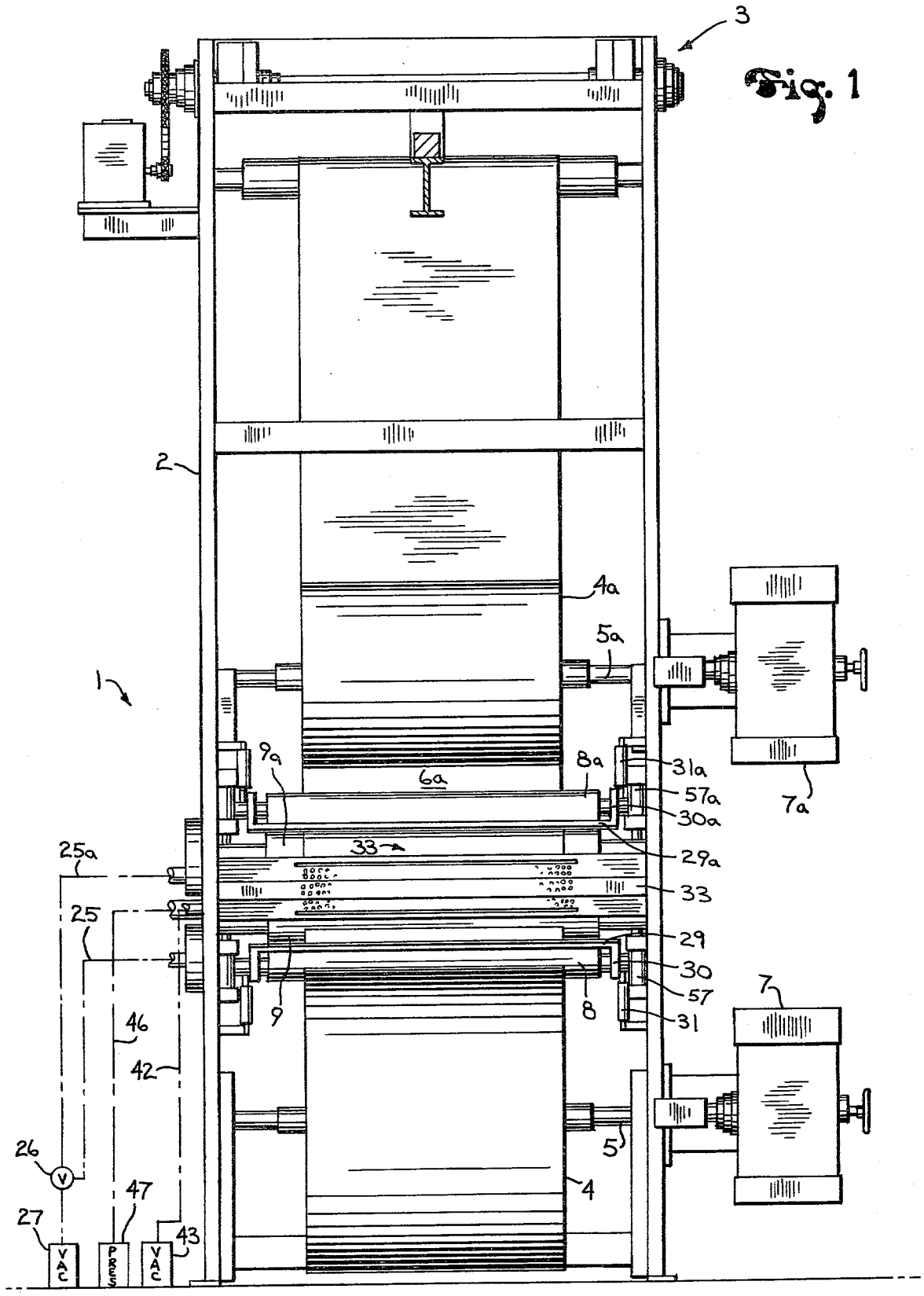
FIG. 1 is a front end elevation of a paper roll web splicing device embodying the concepts of the invention.
Figure 2:
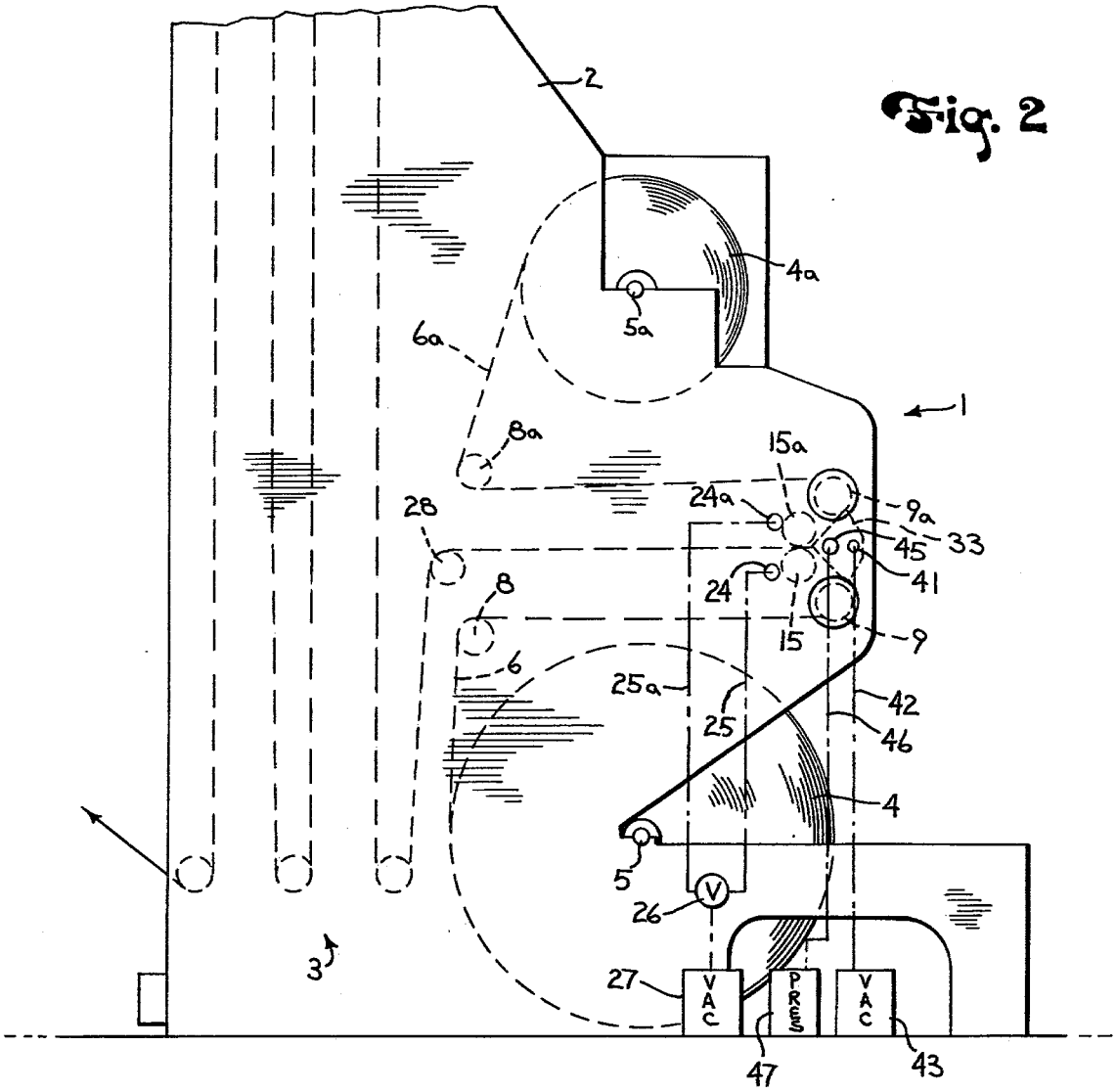
FIG. 2 is a schematic right side elevation of the device.
Figure 3:
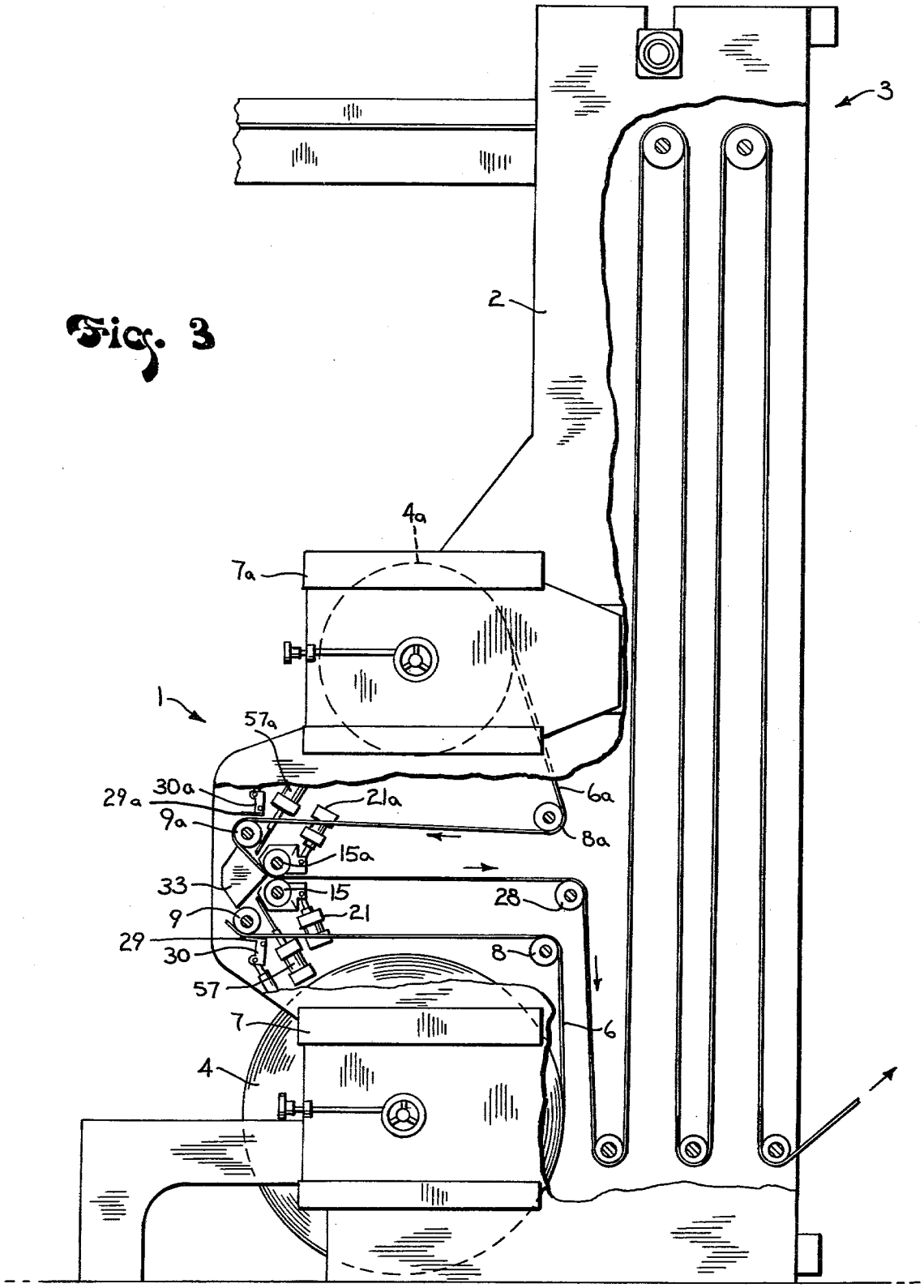
FIG. 3 is a schematic left side elevation of the device, with parts broken away.

As shown in the drawings, and referring particularly to FIGS. 1–3, the concepts of the invention are adapted to be utilized in a splicer 1 having a frame 2 for use with any type of web handling machine having an input nip, not shown. Between splicer 1 and the said nip, an accumulator device 3 is positioned and with the device having the usual dancer roll.

The web handling machine downstream of splicer 1 and accumulator 3 may be adapted to process any selected material, but in this instance it is assumed the material is paper. For this purpose, a pair of paper rolls 4,4a are adapted to be disposed in association with the splicer with the rolls being mounted on shafts 5,5a journalled on frame 2 and having webs 6,6a extending therefrom. Shafts 5,5a may also be connected to suitable braking devices 7,7a.

Figure 4:
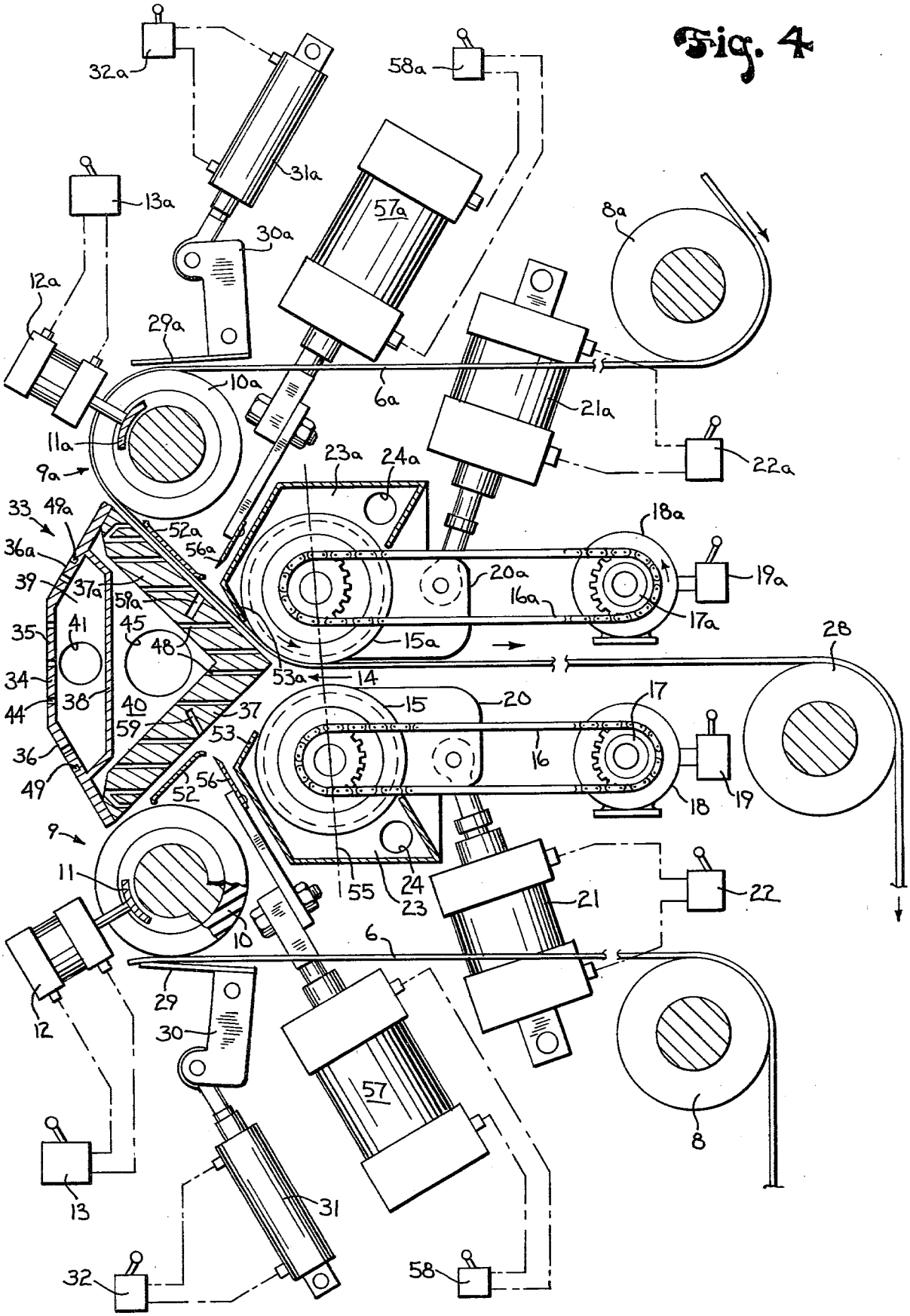
FIG. 4 is an enlarged fragmentary partially sectional view of the splicer mechanism with paper running through the device from the upper roll.

Turning to FIG. 4, guiding idler rolls 8,8a are disposed between paper rolls 4,4a and the input to splicer 1. The splicer includes a plurality of pairs of opposed similar elements for purposes of handling and splicing the paper. For this purpose, spaced idler rolls 9,9a are disposed adjacent the input to the splicer mechanism, with rolls 9,9a having a high friction urethane coating 10,10a thereon for purposes to be described. Brake elements 11,11a are connected to a suitable actuating device such as hydraulic cylinders 12,12a which are actuatable by suitable valves 13,13a in any desired manner.

A splicing nip 14 is disposed downstream of input idler rolls 9,9a. Nip 14 is formed by a pair of nip rolls 15, 15a which are connected through chains 16,16a or the like to clutches 17,17a and driving motors 18,18a. The motors may be actuated in any suitable manner, as by switches 19,19a. The drive is such that nip rolls 15,15a will idle when motors 18, 18a are deactivated, and will be clutched in to rotate when the motors are activated.

Nip rolls 15,15a may also have a high friction urethane or rubber-like surface thereon, and are mounted to frames 20,20a which are shiftable as by hydraulic cylinders 21,21a and control valves 22,22a to open or close nip 14. In FIG. 4, the nip is open. Frames 20,20a include plenums 23,23a disposed about the respective nip rolls 15,15a and vacuum outlets 24,24a connected through lines 25,25a to a selective control valve 26 and hence to a source of vacuum such as a pump 27, as best shown in FIG. 2.

During normal operation of the downstream web handling machine, the web 6 or 6a passes over its respective input idler roll 9,9a, over the respective idling nip roll 15,15a and hence to an output idler roll 28 and accumulator 3.

During preparation of a web 6 or 6a to replace an expiring web, it is desirable to clamp the fresh web to the respective input roll 9 or 9a. For this purpose, elongated relatively thin flexible spring bars 29,29a are disposed along the entire face of the rolls 9,9a and are attached through pivoting levers 30,30a to respective cylinders 31,31a which are actuated by suitable valves 32,32a to move the springs toward or away from the input rolls. Compare the upper and lower portions of FIG. 4.

For purposes of illustration, it is assumed that web 6a has been running through the machine and is about to expire. It is desired to bring a fresh web 6 up from roll 4, splice it to web 6a, sever web 6a upstream of the splice and then permit the new web 6 to run downstream to the accumulator. During the preparation of web 6, web 6a continues to run over idlers 9a and 15a through the open hip 14 and to roll 28.

One aspect of the invention includes utilization of a paper preparation head which facilitates preparation and manual threading of the web 6 to splicing nip 14. As shown in FIGS. 1, 3 and 4, the head is designated at 33 and comprises an elongated element extending from side to side of the device and disposed adjacent and generally between input idler rolls 9 and 9a. Head 33 is multi-faced and includes an exposed front wall 34 having a generally flat central face portion 35 which merges into two rearwardly angled, bottom and top face portions 36, 36a. The lower and upper edges of wall 34 connect with a pair of rearwardly extending back walls 37,37a which join at the back of the head at an apex diposed at the entrance to nip 14. In section, head 33 is thus generally triangular or diamond-shaped.

The interior of head 33 is hollow, and an elongated partition 38 extends through the head to form a front chamber 39 and a rear chamber 40. Chamber 39 is connected through an outlet 41 and a line 42 to a vacuum pump 43, and wall 34 is provided with a plurality of small openings 44 to threreby apply vacuum to the front face of the head when the pump is operating. The vacuum may be of any suitable amount, such as 50 inches of water. Likewise, chamber 40 is connected through an outlet 45 and a line 46 to a pressure pump 47 which provides a low pressure on the order of 2 psi. Rear walls 37,37a are provided with parallel openings 48 to thereby apply an outwardly directed air pressure from chamber 40 through the rear face of the head.

Figure 5:
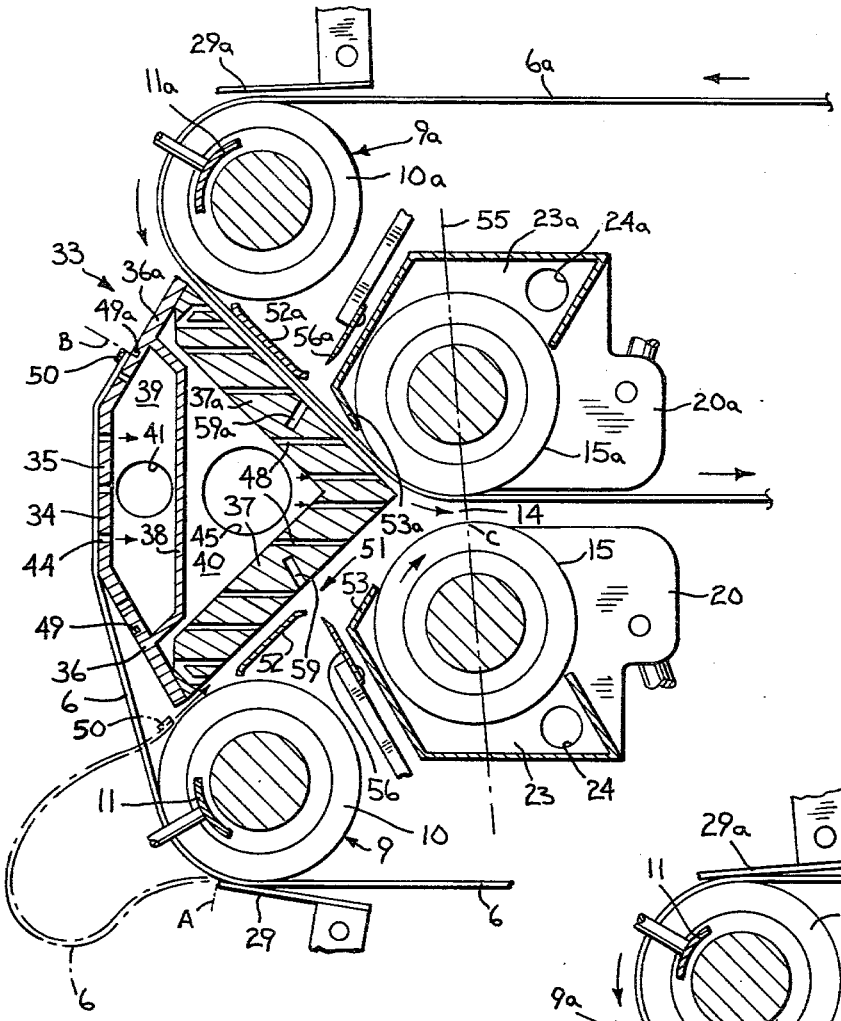
FIG. 5 is a view similar to FIG. 4 and showing preparation of the leading end of a fresh web from the lower roll and initial feeding of the prepared end into the guide channel.

Turning now to FIGS. 4 and 5, in the initial stages of preparation of the fresh web 6, the web is manually unrolled from its roll 4 and threaded between spring clamp 29 and idling roll 9. Clamp cylinder 31 has been actuated to firmly hold web 6 against roll 9 so that the web will not fall free of the roll. Web 6 is then pulled up over head front wall 34 so that its end portion is disposed over upper face portion 36a on the side of head 33 remote from roll 9. See the full lines in FIG. 5. Chamber 39 is vacuumized at this time by activating vacuum pump 43 to thereby hold web 6 to front wall 34 via openings 44. A pair of cut-off slots 49,49a are disposed in respective faces 36,36a. An adhesive is applied to the outer face of the leading edge portion of web 6. In the present instance, a double faced sticky tape 50 is applied and with the tape having adhesive on its back side so that the tape adheres to web 6, and also with adhesive exposed on its front side for subsequent splicing. A knife is then passed through the remote slot 49a to form a straight leading edge for web 6.

It is next desired to thread the end of fresh web 6 toward the splicing nip 14. At the same time, it is desired to substantially eliminate any tendency of tape 50 to undesirably adhere to the device as it proceeds to the nip. For this purpose, a guide channel 51 is formed by the adjacent elements for movement of the web therethrough. One side of the channel comprises head rear wall 37, and the other side comprises roll 9, a guide plate 52 disposed adjacent roll 9 and spaced from wall 37, and a downstream lip 53 formed in the housing of plenum 23.

Figure 6:
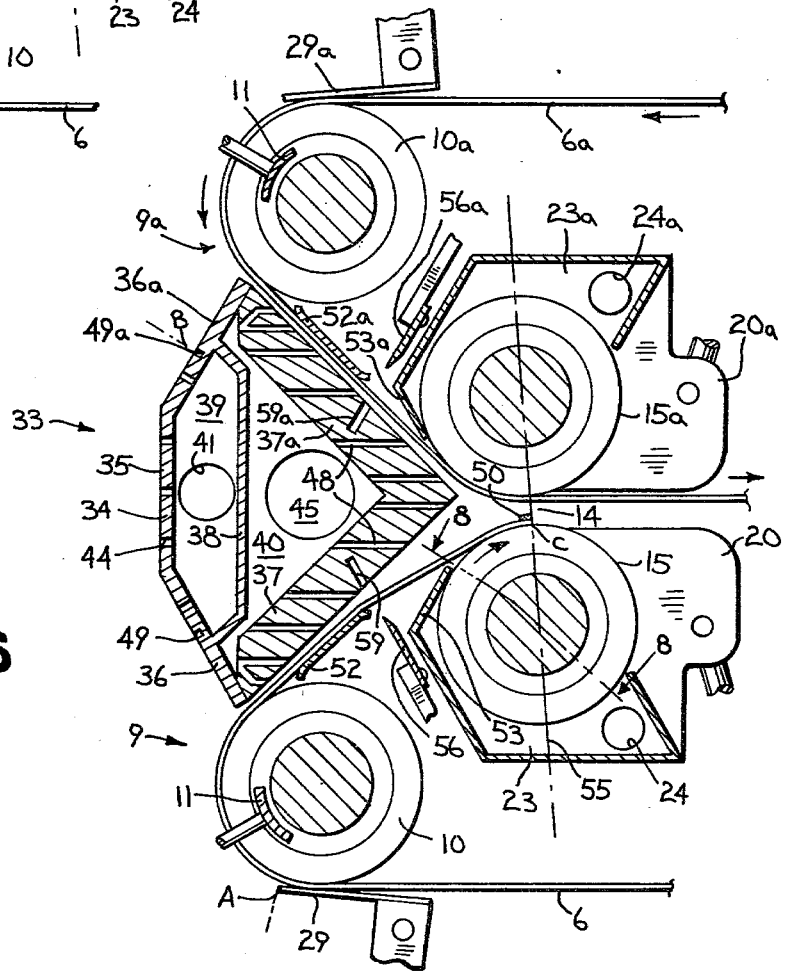
FIG. 6 is a view similar to FIG. 4 and showing the leading edge of the fresh web automatically positioned at the splicing nip.

The prepared web 6 is peeled back across front head wall 34 to form a loop, shown in phantom lines in FIG. 5. The leading end of the web is then inserted between roll 9 and head wall 37. At the same time, pressure is applied to chamber 40 and outwardly through openings 48, vacuum is applied to plenum 23 and motor 18 is activated to continuously rotate roll 15. As web 6 is fed inwardly, it is forced away from wall 37 by the air pressure to prevent contact by tape 50 with the wall. At the same time, and because of the low air pressure which forms an air bearing, web 6 tends to float between wall 37 and plate 52 and lip 53 and easily proceeds toward nip 14. When the leading end of web 6 reaches nip roll 15 downstream of the guide channel 51, it is brought into engagement therewith by a combination of the outward positive pressure air flow through openings 48 and the negative pressure or vacuum applied to the periphery of roll 15 from plenum 23 and through peripheral grooves 54 in the roll. See FIG. 8. As web 6 engages roll 15, the rotation of the latter pulls web 6 inwardly until tape 50 is disposed between nip rolls 15 and 15a and ready for splicing, as shown in FIG. 6.

Another aspect of the invention involves the automatic positioning of the leading edge of the fresh web exactly at nip 14, even though the operator cannot readily see the nip from the front. It is to be observed from FIGS. 5 and 6 that the axes of spaced nip rolls 15 and 15a lie in a common plane 55 with the plane passing through the bridging space between the rolls during fresh web preparation and prior to splicing. Furthermore, the device is constructed so that the length of the web path AB from the edge of clamping spring 29 to the inner edge of remote cut-off slot 49a is exactly equal to the length of the threaded web path AC from the edge of clamping spring 29 to the nip at plane 55 between the nip rolls. When the operator forms the web loop shown in phantom in FIG. 5 and threads the web behind head 33, he need not observe the nip to make sure the leading edge of web 6 is properly positioned. The positioning will be automatic and the web edge will be properly positioned at plane 55 when web 6 no longer forms a loop and passes tightly around idler roll 9 as shown in FIG. 6.

Referring to FIG. 7, once fresh web 6 with adhesive 50 is splice-ready, vacuum pumps 27 and 43 and pressure pump 47 are turned off, clamp spring 29 is withdrawn and motor 18 for nip roll 15 is de-energized. Web 6a continues to run through the guide channel formed by head wall 37a and the adjacent guide plate 52a and plenum lip 53a. As soon as the trailing edge of web 6a releases from expiring roll 4a, spring 29a is actuated to move against the web and brake 11a is energized to bring the roll 9a and web 6a to a momentary stop. At this time, nip roll 15 is shifted toward roll 15a to bring tape 50 into splicing engagement with web 6a. Furthermore, a knife 56a is actuated by a cylinder 57a and control valve 58a to enter a slot 59a disposed in back wall 37a of head 33 to thereby sever the trailing end portion of the expiring web between guide plate 52a and lip 53a. As soon as this occurs, the fresh web is free to be pulled downstream to and through accumulator 3.

While web 6 is subsequently running, a new fresh paper roll may replace old roll 4a and its leading edge prepared in the same manner as described above by the opposite elements of the various pairs.

As previously discussed heretofore, prior known web splicing devices have utilized paper stop bars to clampingly brake the expiring web and drag the web to a halt. The braking force applied, while controllable to some extent, could not readily take into account such factors as different web widths for different web handling applications, varying tensions on the traveling web caused by accumulator position as well as variable machine friction, and the like. Problems of web breakage during application of the brake have testified to the lack of precise control at this critical time. Furthermore, with paper stop bars it has not been possible to decelerate the web at a constant rate.

It is desirable to replace the expiring web, such as 6a in FIG. 7, in the shortest possible time in view of the fact that paper continues to proceed through accumulator 3 while splicing takes place. In this regard, the time necessary for braking of the expiring web to a complete stop is one of the key factors.

In accordance with yet another aspect of the invention, the heretofore used paper stop bar concept has been replaced with a concept which utilizes constant high braking torque and high idler roll inertia. Referring to FIG. 7, one paper stop bar has been replaced by the flexible clamping bar spring 29a, while the other paper stop bar has been replaced by rotatable roll 9a.

First of all, when it is desired to stop web 6a, clamping spring 29a is loaded lightly against the web and brake 11a is then applied to roll 9a. In view of the high friction surface coating 10a on roll 9a as well as spring 29a, web 6a will hold to the roll all the way around the spring 29a to the guide channel behind head 33 during braking and will not slip.

Secondly, use of a rotatable roll 9a on one side of the web braking mechanism makes it possible to take advantage of the derived formula:

$$\dot{\theta}=(T_w-T_v/J)t+\dot{\theta}_0$$

where $\dot{\theta}$ = angular velocity of the roll $T_w$ = torque created on running roll by running web tension $T_v$ = constant braking torque applied to roll $J$ = inertia of rotating roll $\dot{\theta}_0$ = initial angular velocity of roll at moment brake is applied $t$ = time The torque $T_w$ created on the running roll by running web tension is derived by multiplying the roll radius by the running web tension. Thus, with a roll of 2" radius and a maximum expected running web tension of 200 lb., the maximum torque $T_w$ would be 400 inch pounds.

It is desired to make the causes of running web tension (web width, machine friction, etc.) as insignificant as possible so that the braking operation may be precisely controlled. It has been found that if the actual braking torque $T_v$ is a minimum of five times, and preferably at least ten times, $T_w$, the effect in the formula will be to mask or swamp any changes in $T_w$ to thereby precisely control the braking. Using the above example, with a maximum running web tension torque of 400 inch pounds, the braking torque $T_v$ applied to roll 9a should be a minimum of 2000 inch pounds and preferably at least 4000 inch pounds and should be constant.

With $T_w$ being known and $T_v$ being selected therefrom in accordance with the above minimum 5-to-1 ratio concept, a suitable minimum braking time t may be selected which will not cause undesirable over-acceleration of downstream machine parts, such as the dancer roll at accumulator 3. Such overacceleration could cause the downstream web to slip on the dancer roll. Actually, the time t may be selected by picking a suitable rotative inertia J for roll 9a, which is dependent on the formula $WR^2$ where W is the mass of the roll and R is the roll's radius. J should be as high as possible to thereby decrease the time.

The braking torque $T_v$ should not be less than about 5 times the torque $T_w$ on the running roll 9a in order to maintain the time advantage gained with use of the formula.

It can be seen from the above formula, which is usable because of the inventive concepts, that the angular velocity $\dot{\theta}$ of roll 9a will decrease linearly with time. In view of the firm connection between web 6a and the roll, the web will be decelerated at a constant rate and the time involved will be commensurate with the above-discussed factors.

Figure 9:
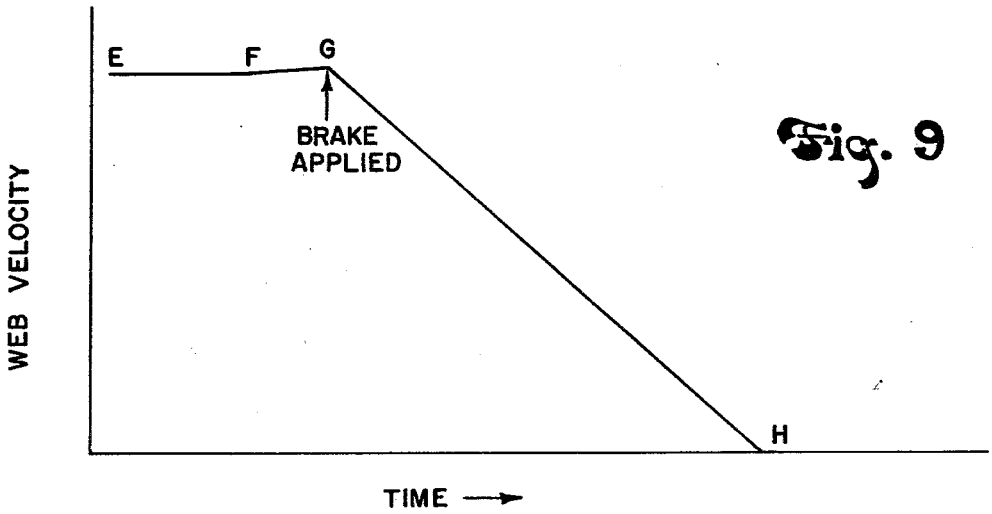
FIG. 9 is a graph showing the relationship of web velocity and time when a constant braking force is applied to the idler roll.

Referring to FIG. 9 wherein the velocity of a web 6a is plotted against time, the graph portion E–F shows the relatively constant velocity of the web during normal run-out. At F, the velocity begins to increase slightly due to release of the trailing portion of web 6a from the supply roll 4a. The brake of a controlled high negative torque is applied at G. Thereupon, the velocity of web 6a decreases in a straight line (linearly) relative to time until at H the velocity is 0, and the web 6a has stopped with the roll.

The desired braking shown in FIG. 9 and in accordance with the above formula makes insignificant the incidental effects of paper roll width and tension, machine friction, etc. The stopping time will be the same whether the web is 20" or 40" wide, or whether the web tension varies between 1 lb./in. and 5 lb./in. In fact, even if the trailing end of web 6a should suddenly be released from its supply roll 4a before brake 11a is applied, as at F in FIG. 9, the web won't suddenly be accelerated forward to any appreciable degree by the tension from the downstream accumulator and dancer roll. This is due to the high inertia of roll 9a and the confining action of spring 29a. The lightly loaded spring 29a will hold the web to the high friction surface of roll 9a and, when the constant high negative torque brake is subsequently applied, the effect of the downstream tensions will be negligable.

Various modes of carrying out the invention are contemplated as being within the scope of the following claims particularly pointing out and distinctly claiming the subject matter which is regarded as the invention.

I claim:

1. For use in a machine for utilizing a traveling continuous web of paper or the like and wherein a plurality of supply rolls are provided so that when the web of one roll is nearly exhausted, the fresh web of a new roll can be substituted therefor, apparatus comprising:

(a) a frame, (b) A splicing mechanism on said frame and with said mechanism including:

(1) a pair of spaced input idler rolls for receiving webs from the supply rolls, (2) and a pair of normally spaced nip rolls disposed downstream of said idler rolls and forming a splicing nip therebetween through which running web normally passes, (c) an elongated paper preparation head disposed between said idler rolls and extending rearwardly toward said nip rolls, (d) first means associated with the front portion of said head for securely holding the leading end portion of a fresh web to the head for preparation by cut-off and application of adhesive to the outer face of the web edge portion, (e) and second means associated with a rearwardly extending portion of said head for pressurizingly forcing a prepared fresh web being threaded along said rearwardly extending head portion away from the latter to prevent engagement by the adhesive on said web edge portion with said rearwardly extending head portion.

2. The apparatus of claim 1 wherein said first means comprises:

(a) a front wall on said head and with said front wall having a plurality of openings therein, (b) and means to apply a negative pressure at said openings to thereby hold a fresh web to said front wall.

3. The apparatus of claim 1 or 2 wherein said second means comprises:

(a) a pair of rear walls on said head with each rear wall forming a said rearwardly extending head portion, and with said rear walls having a plurality of openings therein, (b) and means to apply a positive pressure at said last-named openings to thereby force an adjacent web away fron the respective rear wall.

4. The apparatus of claim 1:

(a) wherein said head is hollow, (b) and which includes an elongated partition extending through the head interior to form a front chamber and a rear chamber.

5. The apparatus of claim 4 wherein said first means includes:

(a) a front wall on said head and with said front wall having a plurality of openings therein which communicate with said front chamber.

(b) and a vacuum pump connected to said front chamber.

6. The apparatus of claim 4 or 5 wherein said second means includes:

(a) a pair of rear walls on said head with each rear wall forming said rearwardly extending head portion, and with said rear walls having a plurality of openings therein which communicate with said rear chamber, (b) and a pressure pump connected to said rear chamber.

7. The apparatus of claim 1:

(a) wherein said second means comprises:

(1) a pair of rear walls on said head with each rear wall forming said rearwardly extending head portion, and with said rear walls having a plurality of openings therein, (2) and means to apply a positive pressure at said openings to thereby force an adjacent web away from the respective rear wall, (b) and which includes means forming a guide channel for fresh web being threaded along a said rear wall.

8. The apparatus of claim 7 wherein said guide channel forming means comprises a guide plate disposed adjacent each said input idler roll and spaced from its respective rear wall.

9. In the apparatus of claim 8:

(a) a plenum disposed about each said nip roll and with each plenum forming a lip disposed downstream of the respective guide plate, (b) said lip forming part of said guide channel forming means.

10. In the apparatus of claim 9:

(a) a cut-off slot disposed in each head rear wall, (b) and severing means adapted to pass between said guide plate and said lip and into said slot for severing and expiring web.

11. In the apparatus of claim 9:

(a) means to supply negative pressure to each said plenum and to the surface of each said nip roll, (b) the negative pressure at the nip roll surface coacting with the positive pressure at said head openings to cause the leading end portion of a said fresh web to be brought into engagement with the surface of the respective nip roll downstream of said guide channel.

12. The apparatus of claim 11 which includes drive means to rotate said respective nip roll during engagement of said fresh web therewith.

13. The apparatus of claim 2:

(a) wherein the axes of said nip rolls lie in a common plane which passes through said splicing nip, (b) wherein said head front wall includes a knife cut-off slot disposed adjacent each said input idler roll for forming the leading edge of a fresh web, (c) and which includes a flexible clamping spring disposed adjacent each said input idler roll upstream from said head and adapted to clamp a web against the idler roll, (d) the construction being such that the prepared fresh web is threadable between its respective idler roll and behind said head toward said nip.

14. In the apparatus of claim 13:

(a) a high friction surface on said nip rolls, (b) and drive means to rotate the respective nip roll to thereby carry the said prepared threaded web to said nip.

15. The apparatus of claim 14 wherein the web path distance between each clamping spring and the said cut-off slot remote from said spring equals the threaded web path distance between each clamping spring and the said plane to thereby provide automatic placement of the leading edge of the said fresh web at the said nip.

16. In the apparatus of claim 1, 4 or 7:

(a) a flexible clamping spring disposed adjacent each said input idler roll upstream from said head and adapted to clamp a running expiring web against its adjacent idler roll, (b) a high friction surface on each said idler roll, (c) and means to brake the said adjacent idler roll so that said expiring web is braked therewith to a stop.

17. The apparatus of claim 16 wherein:

(a) said adjacent idler roll has a relatively high rotative inertia, (b) and said braking means applies a constant negative torque at a minimum of about five times the torque created on said adjacent idler roll by the running expiring web.

18. For use in a machine for utilizing a traveling continuous web of paper or the like and wherein a plurality of supply rolls are provided so that when the web of one roll is nearly exhausted, the fresh web of a new roll can be substituted therefor, apparatus comprising:

(a) a frame, (b) a splicing mechanism on said frame and with said mechanism including:

(1) a pair of spaced input idler rolls for receiving webs from the supply rolls, (2) and a pair of normally spaced nip rolls disposed downstream of said idler rolls and forming a splicing nip therebetween through which running web normally passes, (c) an elongated paper preparation head disposed between said idler rolls and extending rearwardly toward said nip rolls, (d) a flexible clamping spring disposed adjacent each said input idler roll upstream from said head and adapted to clamp a running expiring web against its adjacent idler roll, (e) a high friction surface on each said idler roll, (f) and means to brake the said adjacent idler roll so that said expiring web is braked therewith to a stop.

19. The apparatus of claim 18 wherein:

(a) said adjacent idler roll has a relatively high rotative inertia, (b) and said braking means applies a constant negative torque at a minimum of about five times the torque created on said adjacent idler roll by the running expiring web.

20. The apparatus of claim 17 or 19 wherein the said negative torque is applied in accordance with the formula:

$$\dot{\theta}=(T_w-T_v/J)t+\dot{\theta}_0$$

where $\dot{\theta}$=angular velocity of the roll $T_w$=torque created on running roll by running web tension $T_v$=constant braking torque applied to roll J=inertia of rotating roll $\dot{\theta}_0$=initial angular velocity of roll at moment brake is applied.

t=time

21. The apparatus of claim 17 or 19 wherein the high rotative inertia of said idler roll together with said clamping spring forms means to limit sudden acceleration of the said running web when the trailing end of the latter is released from its supply roll.

22. A method for use in connection with a machine for utilizing a traveling continuous web of paper or the like and wherein a plurality of supply rolls are provided so that when the web of one roll is nearly exhausted, a fresh web of a new roll can be substituted therefor, said method comprising the steps of:

(a) providing spaced first and second high friction surfaced idler rolls with said idler rolls having high rotative inertias, (b) providing spaced first and second high friction surfaced nip rolls downstream of said idler rolls to thereby form a splicing nip, (c) running an expiring web over said first idler roll and through said nip to the said machine, (d) preparing the leading end of a fresh web at a head disposed upstream of said nip rolls and between said idler rolls while holding said fresh web to said second idler roll, (e) forming a loop in said fresh web and threading the latter rearwardly between said head and said second idler roll and toward said nip, (f) pressurizingly forcing the threaded end of said fresh web away from said head and into engagement with said second nip roll while rotating the latter to draw the fresh web automatically to said nip, (g) confining said expiring running web against said first idler roll, (h) applying a brake of constant force and high negative torque to said first idler roll to cause said confined expiring web to be braked therewith to a stop, and with said torque being a minimum of about five times the torque created on said first idler roll by the running expiring web, (i) splicing said prepared fresh web to said stopped expiring web at said nip, (j) and severing said expiring web upstream of said nip.

* * * * *

UNITED STATES PATENT AND TRADEMARK OFFICE

CERTIFICATE OF CORRECTION

PATENT NO. : 4,190,475

DATED : February 26, 1980

INVENTOR(S) : Carl R. Marschke

It is certified that error appears in the above-identified patent and that said Letters Patent are hereby corrected as shown below:

| | |
|---|---|
| Column 4, Line 23 | Delete "hip" and substitute therefor ----nip---- |
| Column 6, Line 44 | Delete "the", 3rd occurrence and substitute therefor ----from---- |
| Column 6, Line 51 | Delete "$\theta=(T_w-T_v/j)t+\theta_o$" and substitute therefor ----$\theta=(\frac{T_w-T_v}{j})t+\theta_o$---- |
| Column 10, Line 43 | Delete "$\theta=(T_w-T_v/j)t+\theta_o$" and substitute therefor ---- $\theta=(\frac{T_w-T_v}{j})t+\theta_o$---- |

Signed and Sealed this

Eighth Day of July 1980

[SEAL]

Attest:

SIDNEY A. DIAMOND

Attesting Officer

Commissioner of Patents and Trademarks